US008818235B2

(12) United States Patent
Kishi

(10) Patent No.: US 8,818,235 B2
(45) Date of Patent: Aug. 26, 2014

(54) DEVELOPING UNIT, PROCESS UNIT, AND IMAGE FORMING DEVICE

(75) Inventor: Isao Kishi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 55 days.

(21) Appl. No.: 13/412,805

(22) Filed: Mar. 6, 2012

(65) Prior Publication Data

US 2012/0269547 A1 Oct. 25, 2012

(30) Foreign Application Priority Data

Apr. 22, 2011 (JP) ..... 2011-096389

(51) Int. Cl.
*G03G 21/18* (2006.01)

(52) U.S. Cl.
USPC ..... 399/113

(58) Field of Classification Search
USPC ..... 399/112, 113
See application file for complete search history.

(56) References Cited

U.S. PATENT DOCUMENTS

| | | | | |
|---|---|---|---|---|
| 7,526,228 | B2 * | 4/2009 | Shiraki | 399/111 |
| 2008/0031656 | A1 | 2/2008 | Okabe | |
| 2009/0220274 | A1 * | 9/2009 | Hashimoto | 399/113 |

FOREIGN PATENT DOCUMENTS

| | | |
|---|---|---|
| JP | 62-137440 | 8/1987 |
| JP | 62-137449 | 8/1987 |
| JP | 62-137450 | 8/1987 |
| JP | 62-137451 | 8/1987 |
| JP | 62-137452 | 8/1987 |
| JP | 2008-026486 | 2/2008 |

* cited by examiner

*Primary Examiner* — Walter L Lindsay, Jr.
*Assistant Examiner* — Philip Marcus T Fadul
(74) *Attorney, Agent, or Firm* — Banner & Witcoff, Ltd.

(57) ABSTRACT

A developing unit detachably mountable in a photosensitive member unit including a photosensitive member on which an electrostatic latent image is formable, a pressing member, and a positioning portion includes: a developing unit frame; a developing roller; and a directing portion. The developing roller is rotatably supported to the developing unit frame, and configured to supply developing agent to the electrostatic latent image formed on the photosensitive member. The directing portion is fixed to the developing unit frame for directing the developing unit frame to a predetermined orientation and for fixing a position of the developer unit frame. The directing portion includes: a pressed portion configured to receive a pressure force from the pressing member for moving the developing roller toward the photosensitive member; and a positioned portion abuttable on the positioning portion for positioning the developing unit relative to the photosensitive member unit.

20 Claims, 7 Drawing Sheets

DEVELOPING UNIT, PROCESS UNIT, AND IMAGE FORMING DEVICE

CROSS REFERENCE TO RELATED APPLICATION

This application claims priority from Japanese Patent Application No. 2011-096389 filed Apr. 22, 2011. The entire content of the priority application is incorporated herein by reference.

TECHNICAL FIELD

The present invention relates to a developing unit, a process unit provided with the developing unit, and an electrophotographic type image forming device provided with the process unit.

BACKGROUND

One electrophotographic type image forming device conventionally well known in the art includes a developing unit. One such developing unit is mounted in the image forming device so that a developing roller provided in the developing unit contacts a photosensitive drum provided in the image forming device.

As the developing unit, an image forming cartridge including a cartridge casing and a developing roller has been proposed. The cartridge casing is formed in a generally box shape having a front wall provided with two foot portions at respective widthwise ends and a top wall provided with a pressing operation mechanism. The developing roller is accommodated in the cartridge casing.

When the above image forming cartridge is mounted in the image forming device, a pressure force generated by the pressing operation mechanism urges the image forming cartridge downward. A component of the pressure force brings each foot portion into contact with a guide member, such as a roller, provided at the image forming device. In association therewith, the developing roller is brought into contact with the photosensitive drum. As a result, the image forming cartridge is subjected to positioning relative to the image forming device.

SUMMARY

However, while the image forming cartridge is mounted in the image forming device, a drive force transmitted to the developing roller from the image forming device may rattle the image forming cartridge.

Stable contact between the developing roller and the photosensitive drum may be obstructed by the rattling of the image forming cartridge, which may cause degradation in image formation.

If the pressure force by the pressing operation mechanism increases, contact between the developing roller and the photosensitive drum can be stably maintained. However, a frictional force between the developing roller and the photosensitive drum also increases. Due to the increased frictional force, toner carried on the developing roller may be unintentionally dispersed. This may rather cause degradation in image formation.

In view of the foregoing, it is an object of the present invention to provide a developing unit, a process unit, and an image forming device capable of restraining occurrence of degradation in image formation.

In order to attain the above and other objects, the present invention provides a developing unit detachably mountable in a photosensitive member unit including a photosensitive member on which an electrostatic latent image is formable, a pressing member, and a positioning portion including: a developing unit frame; a developing roller; and a directing portion. The developing roller is rotatably supported to the developing unit frame, and configured to supply developing agent to the electrostatic latent image formed on the photosensitive member. The directing portion is fixed to the developing unit frame for directing the developing unit frame to a predetermined orientation and for fixing a position of the developer unit frame. The directing portion includes: a pressed portion configured to receive a pressure force from the pressing member for moving the developing roller toward the photosensitive member; and a positioned portion abuttable on the positioning portion for positioning the developing unit relative to the photosensitive member unit.

According to another aspect, the present invention provides a process unit including: a developing unit; and a photosensitive member unit. The photosensitive member unit includes a photosensitive member on which an electrostatic latent image is formable, a pressing member, and a positioning portion. The developing unit is detachably mountable in the photosensitive member unit. The developing unit includes: a developing unit frame; a developing roller; and a directing portion. The developing roller is rotatably supported to the developing unit frame, and configured to supply developing agent to the electrostatic latent image formed on the photosensitive member. The directing portion is fixed to the developing unit frame for directing the developing unit frame to a predetermined orientation and for fixing a position of the developer unit frame. The directing portion includes: a pressed portion and a positioned portion. The pressed portion is configured to receive a pressure force from the pressing member for moving the developing roller toward the photosensitive member. The positioned portion is abuttable on the positioning portion for positioning the developing unit relative to the photosensitive member unit.

According to still another aspect, the present invention provides an image forming device comprising the above-described process unit.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
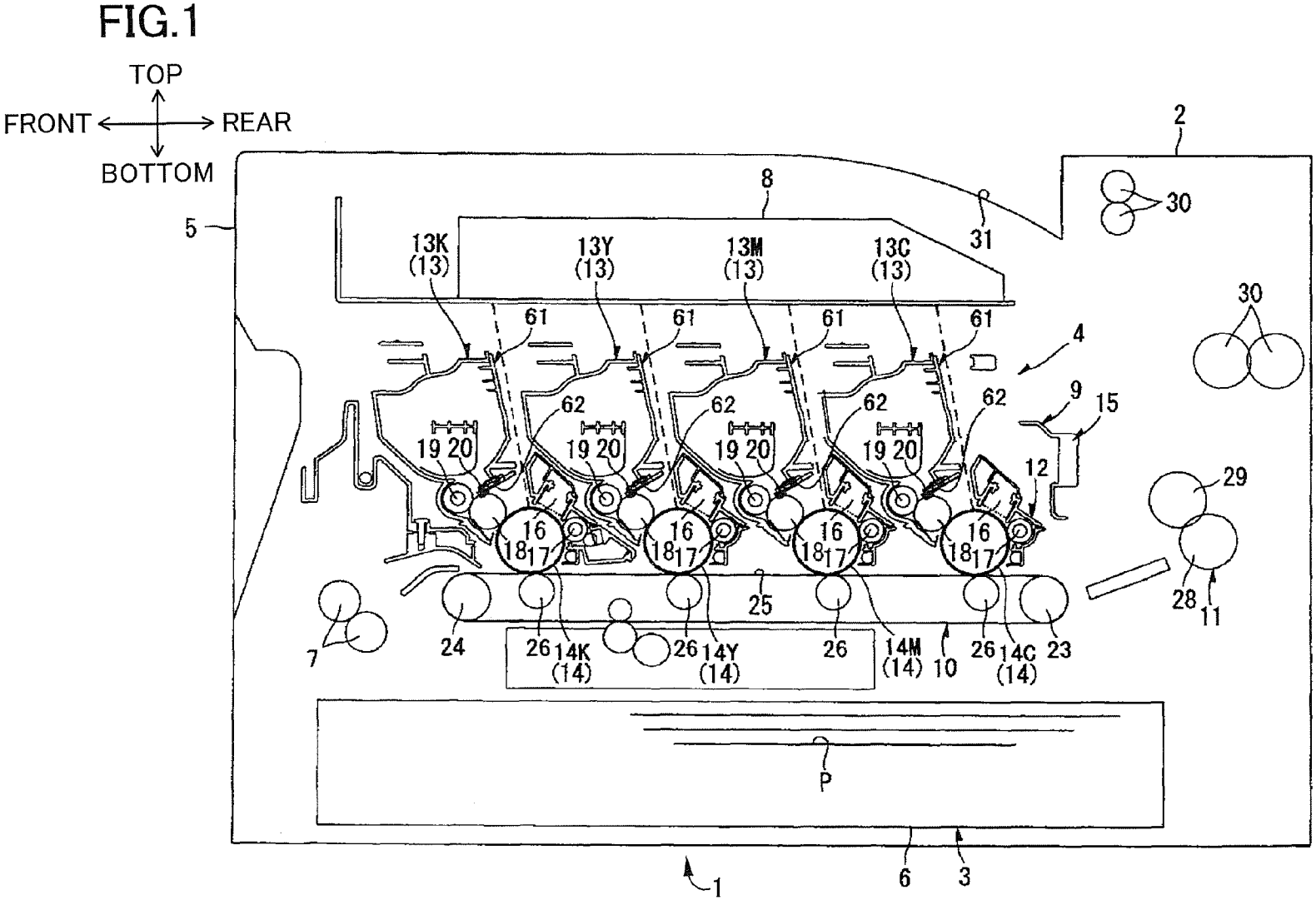
FIG. 1 is a schematic cross-sectional view of a color laser printer as an image forming device according to one embodiment of the present invention.

An image forming device according to one embodiment of the present invention will be described while referring to FIGS. 1 to 7 wherein like parts and components are designated by the same reference numerals to avoid duplicating description.

1. Overall Structure of Color Printer

As shown in FIG. 1, the image forming device according to the embodiment is a horizontal direct tandem type color laser printer 1. The color laser printer 1 includes a main casing 2. Within the main casing 2, a sheet supply unit 3 and an image forming unit 4 are provided. The sheet supply unit 3 serves to supply sheets of paper P to the image forming unit 4. The image forming unit 4 serves to form images on the sheets P supplied from the sheet supply unit 3.

(1) Main Casing

The main casing 2 has a box-shaped configuration that is substantially rectangular in a side view. The sheet supply unit 3 and the image forming unit 4 are accommodated in the main casing 2. The main casing 2 has one side wall on which a front cover 5 is provided. Through the front cover 5, a process unit 9 (described later) is mounted in or removed from the main casing 2. The front cover 5 is pivotally movable relative to the main casing 2 about a lower end thereof.

The terms "upward", "downward", "upper", "lower", "above", "below", "beneath", "right", "left", "front", "rear" and the like will be used throughout the description assuming that the color printer 1 is disposed in an orientation in which it is intended to be used. In the following description, the side of the color printer 1 on which the front cover 5 is provided (left side in FIG. 1) will be referred to as the front side of the color printer 1, and a side opposite to the side (right side in FIG. 1) will be referred to as the rear side of the color printer 1. The top, bottom, left, and right sides of the color printer 1 in the following description will be based on the reference point of a user viewing the color printer 1 from the front side.

(2) Sheet Supply Unit

The sheet supply unit 3 includes a sheet supply tray 6 for accommodating the sheets of paper P. The sheet supply tray 6 is disposed at a bottom portion of the main casing 2. The sheet supply tray 8 is detachably mounted in the main casing 2. A pair of registration rollers 7 is disposed above a front end portion of the sheet supply tray 6.

Each sheet P accommodated in the sheet supply tray 6 is conveyed to a position between the pair of registration rollers 7, and then, conveyed toward the image forming unit 4 (a position between a photosensitive drum 14 (described later) and a conveying belt 25 (described later)) at a prescribed timing.

(3) Image Forming Unit

The image forming unit 4 includes a scanner unit 8, the process unit 9, a transfer unit 10, and a fixing unit 11.

(3-1) Scanner Unit

The scanner unit 8 is disposed at a top portion of the main casing 2. As indicated by broken lines in FIG. 1, the scanner unit 8 irradiates laser beams toward the four photosensitive drums 14 (described later) based on image data to expose the photosensitive drums 14.

(3-2) Process Unit

The process unit 9 is disposed immediate below the scanner unit 8 and above the transfer unit 10. The process unit 9 includes a drum unit 12 and four developing units 13.

The drum unit 12 includes a process frame 15, four photosensitive drums 14, four Scorotron chargers 16, and four drum-cleaning rollers 17. The process frame 15 retains the four photosensitive drums 14, the four Scorotron chargers 16, and the four drum-cleaning rollers 17 therein.

Each photosensitive drum 14 is cylindrical in shape extending in a rightward/leftward direction and oriented with its axis along the rightward/leftward direction. The four photosensitive drums 14 are arranged juxtaposed with each other at regular intervals in a frontward/rearward direction. The four photosensitive drums 14 respectively correspond to black, yellow, magenta, and cyan.

Specifically, the photosensitive drums 14 include a black photosensitive drum 14K, a yellow photosensitive drum 14Y, a magenta photosensitive drum 14M, and a cyan photosensitive drum 14C arranged in this order from front to rear.

The Scorotron chargers 16 are disposed diagonally above and rearward of the respective photosensitive drums 14, and confront but do not contact the photosensitive drums 14.

The drum-cleaning rollers 17 are disposed rearward of the respective photosensitive drums 14, and confront and contact the photosensitive drums 14.

The developing units 13 are detachably mounted in the process frame 15 in a juxtaposed state above the corresponding photosensitive drums 14 and confront the corresponding photosensitive drums 14.

Specifically, the developing units 13 include a black developing unit 13K, a yellow developing unit 13Y, a magenta developing unit 13M, and a cyan developing unit 13C arranged in this order from front to rear.

Further, each of the developing units 13 is provided with a developing roller 18.

Each developing roller 18 is rotatably supported in a lower end of the corresponding developing unit 13. The developing roller 18 has a bottom rear edge exposed through a lower rear edge of the developing unit 13, and confronts and contacts the corresponding photosensitive drum 14 from an upper front.

Each developing unit 13 also includes a supply roller 19 for supplying toner to the corresponding developing roller 18 and a thickness-regulating blade 20 for regulating the thickness of the toner supplied to the developing roller 18. The developing unit 13 accommodates toner for corresponding color in a space defined above the supply roller 19 and the thickness-regulating blade 20.

(3-2-2) Developing Operations of Process Unit

The toner accommodated in each developing unit 13 is supplied onto the corresponding supply roller 19, which in turn supplies the toner to the corresponding developing roller 18. At this time, the toner is positively tribocharged between the supply roller 19 and the developing roller 18.

As the developing roller 18 rotates, the thickness-regulating blade 20 regulates the toner carried on the surface of the developing roller 18 to a prescribed thickness, so that the developing roller 18 carries a uniform thin layer of toner thereon.

In the meantime, the Scorotron charger 16 applies a uniform charge of positive polarity to the surface of the corresponding photosensitive drum 14 while the photosensitive drum 14 rotates. Subsequently, the scanner unit 8 irradiates a laser beam (indicated by the broken line in FIG. 1) in a high-speed scan in order to expose the surface of the respective photosensitive drum 14, thereby forming an electrostatic latent image on the surface of the photosensitive drum 14 based on image data for a respective color corresponding to an image to be formed on the sheet P.

As the photosensitive drum 14 continues to rotate, the positively charged toner carried on the surface of the developing roller 18 is supplied to the electrostatic latent image formed on the surface of the photosensitive drum 14, thereby developing the electrostatic latent image into a visible toner image through reverse development.

(3-3) Transfer Unit

The transfer unit 10 is disposed in the main casing 2 above the sheet supply unit 3 and below the process unit 9, and extends in the frontward/rearward direction. The transfer unit 10 includes a drive roller 23, a follow roller 24, the conveying belt 25, and four transfer rollers 26.

The drive roller 23 and the follow roller 24 are disposed parallel to each other and are separated in the frontward/rearward direction.

The conveying belt 25 is stretched around the drive roller 23 and the follow roller 24, with the top portion of the conveying belt 25 opposing and contacting each of the photosensitive drums 14 from below. When the drive roller 23 is driven to rotate, the follow roller 24 follows the drive roller 23, and the conveying belt 25 circulates in a clockwise direction in FIG. 1 so that the top portion of the conveying belt 25 in contact with the photosensitive drums 14 moves rearward from front.

The transfer rollers 26 are disposed inside the conveying belt 25 at positions opposing corresponding photosensitive drums 14, with the top portion of the conveying belt 25 interposed therebetween.

When the sheet P is supplied from the sheet supply unit 3, the conveying belt 25 conveys the sheet P rearward so that the sheet P passes sequentially through each of transfer positions between the photosensitive drums 14 and the corresponding transfer rollers 26. As the sheet P is conveyed on the conveying belt 25, toner images in each color carried on the respective photosensitive drums 14 are sequentially transferred onto the sheet P to form a color image.

In some cases, residual toner remains on peripheral surfaces of the photosensitive drums 14 after the toner images have been transferred onto the sheet P. Therefore, when the residual waste toner is brought opposite the drum-cleaning roller 17 by the rotation of the photosensitive drum 14, the waste toner is transferred onto the peripheral surface of the drum-cleaning roller 17 owing to a cleaning bias applied to the drum-cleaning roller 17 and is retained on the drum-cleaning roller 17.

(3-4) Fixing Unit

The fixing unit 11 is disposed diagonally above and rearward of the conveying belt 25. The fixing unit 11 includes a heating roller 28 and a pressure roller 29 in pressure contact with the heating roller 28.

After the color image has been transferred onto the sheet P in the transfer unit 10, the color image is thermally fixed to the sheet P by a combination of heat and pressure as the sheet P passes between the heating roller 28 and the pressure roller 29 in the fixing unit 11.

(4) Discharge Section

After the toner image has been fixed to the sheet P, the sheet P is conveyed by each discharge roller 30 so as to pass through a U-shaped path (not shown). The sheet P is then discharged onto a discharge tray 31 formed on the top of the scanner unit 8.

2. Detailed Description of Process Unit (1) Process Frame

Figure 2:
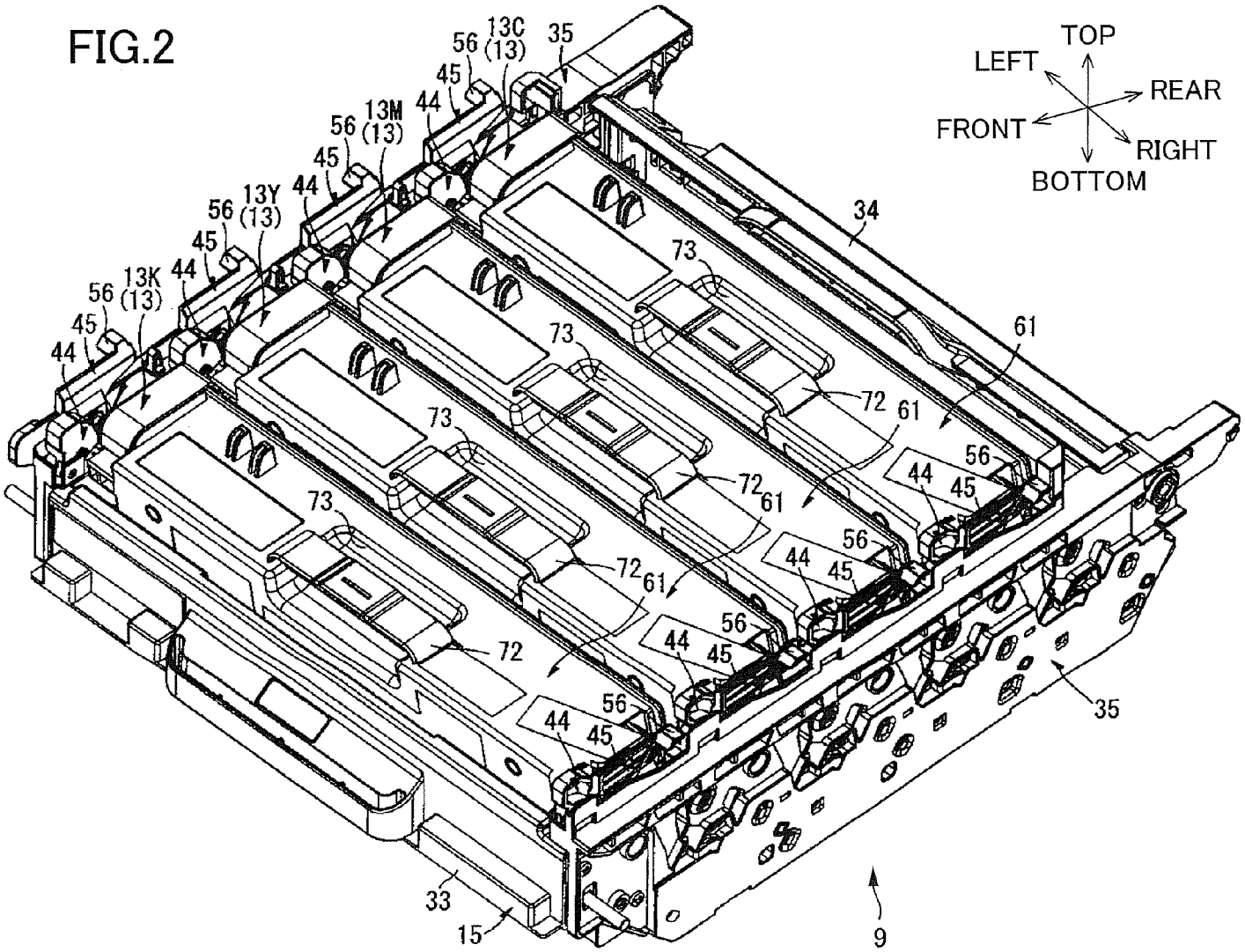
FIG. 2 is a perspective view of a process unit provided in the color laser printer shown in FIG. 1 as viewed from an upper right side.

As shown in FIG. 2, the process frame 15 is formed in a rectangular frame shape in a plan view and elongated in the frontward/rearward direction.

The process frame 15 includes a front beam 33, a rear beam 34, and a pair of right and left side plates 35.

The front beam 33 spans between front edges of the side plates 35 and the rear beam 34 spans between rear edges of the side plates 35.

The side plates 35 are substantially rectangular in a side view and elongated in the frontward/rearward direction. The side plates 35 are arranged in confrontation with each other and spaced apart from each other in the rightward/leftward direction.

Hereinafter, the side plate 35 on the left side will be described in detail, while the description of the side plate 35 on the right side will be omitted for the sake of simplicity. Accordingly, the side plate 35 on the left side will be simply referred to as the side plate 35. Note that, in the present embodiment, structures with respect to a guide groove 39 (described later), a roller 50 (described later), a pressure cam 44 (described later), and a separation cam 45 (described later) provided in the side plate 35 on the left side are the same as those provided in the side plate 35 on the right side.

Figure 6:
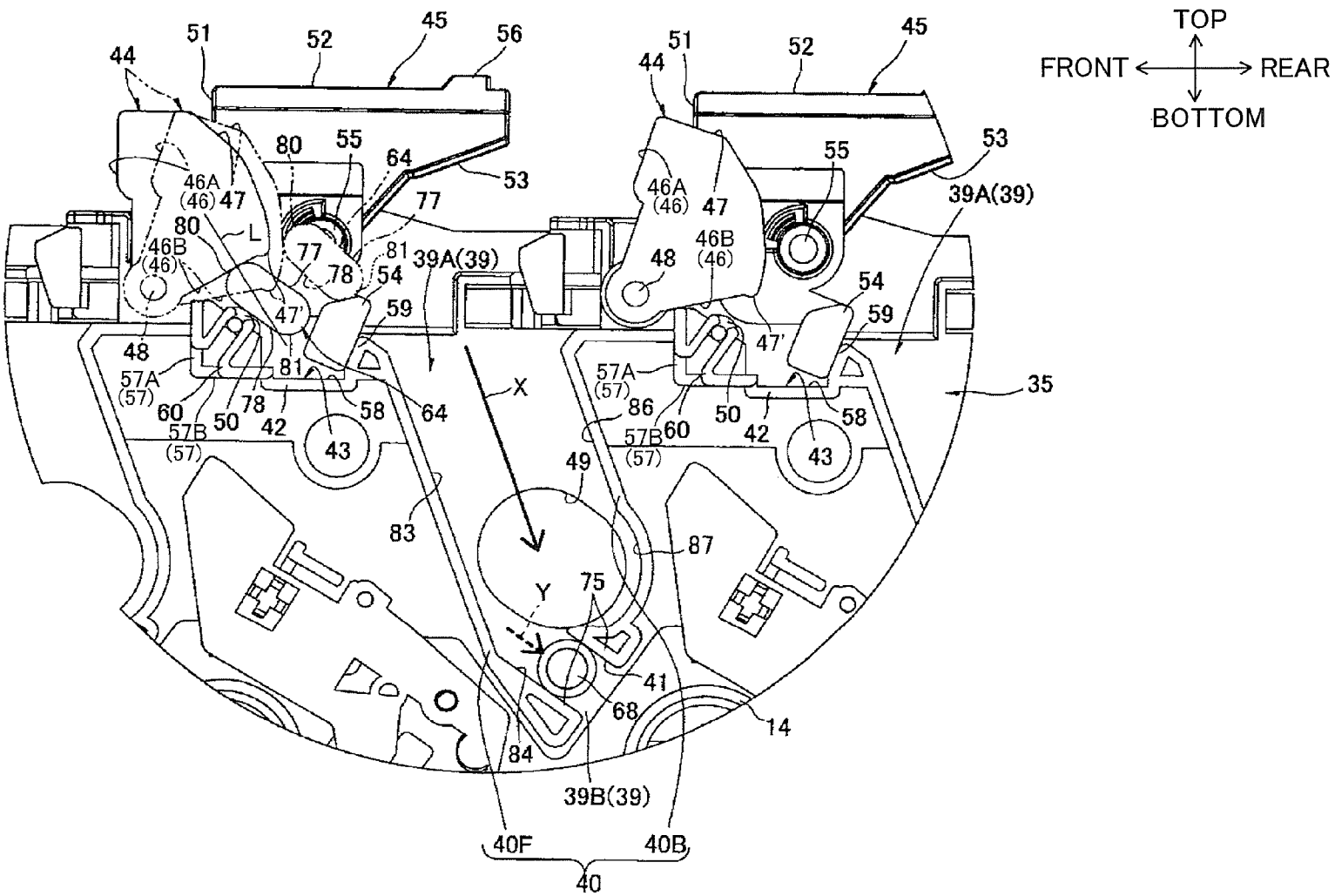
FIG. 6 is a right side view of a left side plate of the process unit shown in FIG. 2.

As shown in FIG. 6, the side plate 35 has an inner surface in the rightward/leftward direction formed with four guide grooves 39.

More specifically, the four guide grooves 39 are formed in the inner (right) surface of the side plate 35 and arranged in the frontward/rearward direction at regular intervals each other. Each guide groove 39 extends diagonally below and rearward from a top edge of the side plate 35 at a position between the top edge of the side plate 35 and the corresponding photosensitive drum 14. The direction in which the guide groove 39 extends is indicated by a bold solid line in FIG. 6 and will be referred to as a first direction X.

Further, the inner surface in the rightward/leftward direction of the side plate 35 is formed with four sets of a pair of front and rear guide ribs 40. The respective pair of guide ribs 40 is provided so as to define the guide groove 39. The respective pair of guide ribs 40 is configured to guide removal of the corresponding developing unit 13 from the drum unit 12 and mounting of the developing unit 13 in the drum unit 12.

Hereinafter, the guide rib 40 on the front side will be referred to as the front guide rib 40F, and the guide rib 40 on the rear side will be referred to as the rear guide rib 40B when it is necessary to distinguish between the two.

The front guide rib 40F and the rear guide rib 40B are arranged spaced apart from each other in the frontward/rearward direction and extend in the first direction X. The front guide rib 40F and the rear guide rib 40B protrude inward in the rightward/leftward direction from the inner surface of the side plate 35. Further, each of the front guide rib 40F and the rear guide rib 40B has a bottom edge opposing the corresponding photosensitive drum 14, with a slight gap therebetween.

The front guide rib 40F has an upper surface 83 and a lower surface 84. The upper surface 83 is generally flat rectangular shaped. The upper surface 83 extends in the first direction X from the top edge of the side plate 35. The lower surface 84 is generally flat rectangular shaped. The lower surface 84 is bent rearward from a bottom end of the upper surface 83 and extends in a direction along a radial direction of the photosensitive drum 14. The direction in which the lower surface 84 extends is indicated by a bold broken line in FIG. 6 and will be referred to as a second direction Y.

The rear guide rib 40B has an upper surface 86, a curved surface 87, and an opposing surface 41. The upper surface 86 is generally flat rectangular shaped. The upper surface 86 extends in the first direction X from the top edge of the side plate 35. The curved surface 87 curves rearward from a bottom end of the upper surface 86 so as to form an arcuate shape.

The opposing surface 41 extends from a bottom end of the curved surface 87 so as to confront the lower surface 84 of the front guide rib 40F with a prescribed gap between the lower surface 84 and the opposing surface 41. The distance between the lower surface 84 and the opposing surface 41 is substantially the same as an outer diameter of a cylindrical portion 68 (described later) of a collar member 67 (described later).

The opposing surface 41 is generally flat rectangular shaped. The opposing surface 41 extends in the second direction Y, in the same manner as the lower surface 84 of the front guide rib 40F.

In other words, each guide groove 39 has a first guide groove 39A that extends in the first direction X from the top edge of the side plate 35, and a second guide groove 39B that is continuous from the first guide groove 39A and that extends in the second direction Y from a bottom edge of the first guide groove 39A.

Note that the second guide groove 39B is not necessarily directly continuous from the bottom edge of the first guide groove 39A. In addition to the first guide groove 39A and the second guide groove 39B, the guide groove 39 may have a third portion (not shown) for connecting the second guide groove 39B to the first guide groove 39A.

Further, the guide ribs 40 defining the second guide groove 39B (a part of the front guide rib 40F having the lower surface 84 and a part of the rear guide rib 40B having the opposing surface 41) has inner end faces in the rightward/leftward direction serving as a restricting surface 75 that is abuttable on a positioning surface 71 (described later) of the collar member 67 (described later).

Further, the side plate 35 is formed with four through-holes 49 at positions adjacent to lower portions of the corresponding guide grooves 39. More specifically, each through-hole 49 is formed at a position adjacent to and forward of the curved surface 87 of the corresponding rear guide rib 40B. Each through-hole 49 penetrates the side plate 35 in the rightward/leftward direction and faces the corresponding guide groove 39.

Incidentally, a coupling member (not shown) for transmitting a drive force of a motor (not shown) provided in the main casing 2 to the developing unit 13 is inserted through the through-hole 49 to be connected to the developing unit 13, thereby transmitting the drive force of the motor to the developing unit 13. Hence, the developing unit 13 is driven by the motor.

Further, the side plate 35 has four extending portions 42 at positions between the neighboring guide grooves 39 disposed next to each other.

Each extending portion 42 extends in the frontward/rearward direction to connect a top edge of the front guide rib 40F defining the guide groove 39 on the rear side to a top edge of the rear guide rib 40B defining the guide groove 39 on the front side.

The extending portion 42 is formed with a depressed portion 43 that is depressed downward from an upper surface thereof.

The depressed portion 43 is defined by a front portion 57, a middle portion 58, and a rear portion 59. The front portion 57 defines a front portion of the depressed portion 43 and is formed in a generally L-shape in a side view. The front portion 57 has a first portion 57A extending in an upward/downward direction and a second portion 57B extending in the frontward/rearward direction. The middle portion 58 is formed in a generally flat-plate shape and connects a rear edge of the front portion 57 (the second portion 57B) and a front edge of the rear portion 59. The rear portion 59 defines a rear portion of the depressed portion 43 and slopes upward toward the rear from a rear edge of the middle portion 58.

Further, the side plate 35 is provided with four rollers 50, four pressure cams 44, and four separation cams 45.

Each roller 50 has a cylindrical configuration. The roller 50 is supported to a support member 60 and rotatable relative to the support member 60.

The support member 60 is fixed to the front portion 57 of the depressed portion 43. The roller 50 is arranged such that a rotation shaft of the roller 50 is perpendicular to a bisector of an angle defined by the L-shaped front portion 57 (i.e. an angle between the first portion 57A and the second portion 57B). That is, each roller 50 is supported to the side plate 35 of the process frame 15, and each pair of guide ribs 40 is integral with the side plate 35 of the process frame 15.

The four pressure cams 44 and the four separation cams 45 are provided at the side plate 35 so that each of the pressure cams 44 and each of the separation cams 45 correspond to each of the guide grooves 39 (FIG. 2). Specifically, the pressure cams 44 and the separation cams 45 are disposed at positions adjacent to and above the corresponding extending portions 42 (FIG. 6).

The pressure cams 44 and the separation cams 45 provided at the right and left side plates 35 are disposed in alignment with right and left end portions of the corresponding developing unit 13 when the developing unit 13 is mounted in the process frame 15.

Each pressure cam 44 is formed in a generally sector-shape in a side view. More specifically, the pressure cam 44 has an upper surface 46A, a lower surface 46B, and an arcuate surface 47.

The upper surface 46A has a lower end that is connected to a front end of the lower surface 46B and an upper end that is connected to an upper end of the arcuate surface 47. The lower surface 46B has a rear end that is connected to a lower end of the arcuate surface 47. The upper surface 46A and the lower surface 46B are arranged so that a distance between the upper surface 46A and the lower surface 46B is gradually increased toward the arcuate surface 47. The arcuate surface 47 curves in a generally arc shape so as to protrude diagonally upward and rearward. The lower surface 46B and the arcuate surface 47 defines a connected portion 47' where the rear end of the lower surface 46B and the lower end of the arcuate surface 47 are connected to each other.

Further, the pressure cam 44 is provided with a rotation shaft 48 extending outward in the rightward/leftward direction at a position adjacent to a position where the lower end of the upper surface 46A and the front end of the lower surface 46B are connected to each other.

The rotation shaft 48 is supported to the inner surface in the rightward/leftward direction of the side plate 35. With this configuration, the pressure cam 44 is pivotally movable about the rotation shaft 48 relative to the side plate 35.

The pressure cam 44 is constantly urged in a clockwise direction in FIG. 6 by an urging member (not shown).

Hence, the pressure cam 44 is normally positioned at a standby position (indicated by a broken line in FIG. 6 on the left side) such that the pressure cam 44 is tilted rearward by an urging force generated by the urging member (not shown). When the pressure cam 44 is pivotally moved about the rotation shaft 48 against the urging force generated by the urging member (not shown), the pressure cam 44 is moved to an upright position. The position where the pressure cam 44 stands upright will be referred to as a pressing position (indicated by a solid line in FIG. 6 on the left side).

Each separation cam 45 is disposed adjacent to the corresponding pressure cam 44 but does not contact the corresponding pressure cam 44 (FIG. 2). More specifically, the separation cam 45 is disposed rearward and outward in the rightward/leftward direction of the corresponding pressure cam 44.

The separation cam 45 is formed in a generally right-angled triangle shape in a side view. The separation cam 45 has a vertical portion 51, a horizontal portion 52, and a slant portion 53. The separation cam 45 has an angle of 90 degrees in its upper front corner. That is, an interior angle defined by the vertical portion 51 and the horizontal portion 52 is a generally right angle. The vertical portion 51 extends vertically downward from a front end of the horizontal portion 52. The horizontal portion 52 extends horizontally rearward from an upper end of the vertical portion 51. The slant portion 53 extends diagonally below and frontward from a rear end of the horizontal portion 52 to a lower end of the vertical portion 51.

The horizontal portion 52 has a rear portion integrally provided with a projecting portion 56. The projecting portion 56 projects upward and outward in the rightward/leftward direction (FIG. 2).

Further, the slant portion 53 has a lower portion integrally provided with a separating portion 54.

The separating portion 54 protrudes inward in the rightward/leftward direction from the separation cam 45. The separating portion 54 is formed in a generally trapezoidal shape in a side view whose upper front portion is cut out. The separating portion 54 is disposed so as to confront the pressure cam 44 in the frontward/rearward direction.

Further, the separation cam 45 has a rotation shaft 55 extending outward in the rightward/leftward direction and disposed at the slant portion 53 at a position above the separating portion 54. The rotation shaft 55 is supported to the inner surface in the rightward/leftward direction of the side plate 35. With this configuration, the separation cam 45 is pivotally movable about the rotation shaft 55 relative to the side plate 35.

The separation cam 45 is constantly urged in a counter-clockwise direction in FIG. 6 by an urging member (not shown).

Hence, the separation cam 45 is normally seated upon the rear portion 59 of the depressed portion 43 formed in the corresponding extending portion 42. That is, the separation cam 45 is normally positioned in a standby position such that the separating portion 54 is tilted diagonally upward and rearward along the sloped rear portion 59.

Further, the separation cam 45 is pivotally moved against an urging force generated by the urging member (not shown) to be positioned in a separation position (not shown).

When both of the pressure cam 44 and the separation cam 45 are in the standby position (shown in FIG. 6 on the right side), the connected portion 47' is in confrontation with and spaced apart from a front surface of the separating portion 54.

(2) Developing Unit

Figure 3:
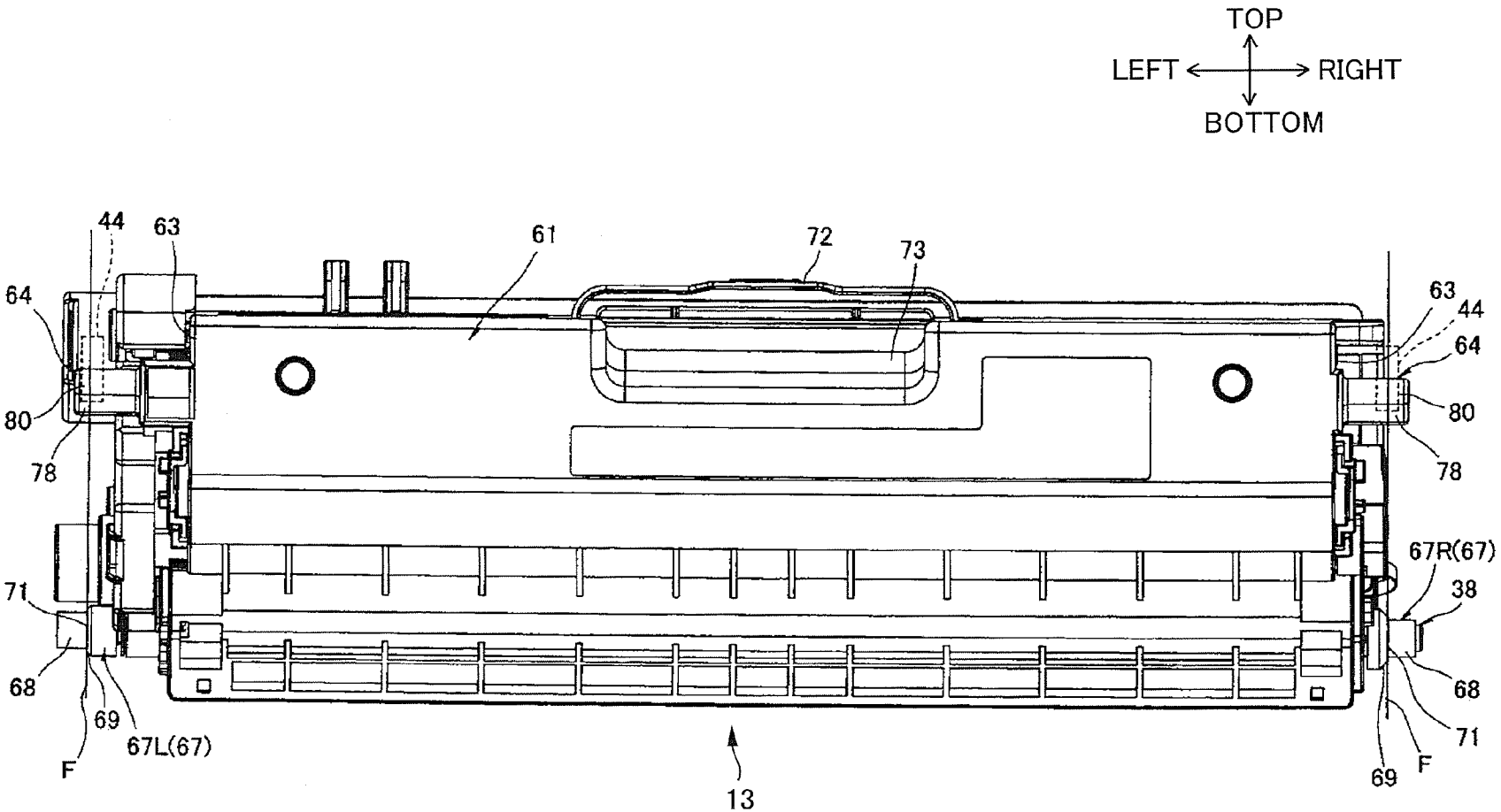
FIG. 3 is a front view of a developing unit provided in the color laser printer shown in FIG. 1.

As shown in FIG. 3, each developing unit 13 includes a developing unit frame 61 and the developing roller 18 (FIG. 1).

The developing unit frame 61 is formed in a generally box-shape elongated in the rightward/leftward direction.

The developing unit frame 61 is integrally provided with a handle 72 at a center portion in the rightward/leftward direction of the developing unit frame 61 and at a top front portion of the developing unit frame 61. Further, the developing unit frame 61 is formed with a notch 73 at a position below the handle 72.

As shown in FIG. 2, at a position below the handle 72, the notch 73 is cut out an upper edge of the developing unit frame 61 downward to form a generally U-shape in a front view having an open top and also cut out a front edge of the developing unit frame 61 rearward to form a generally U-shape in a front view having an open front.

Figure 4:
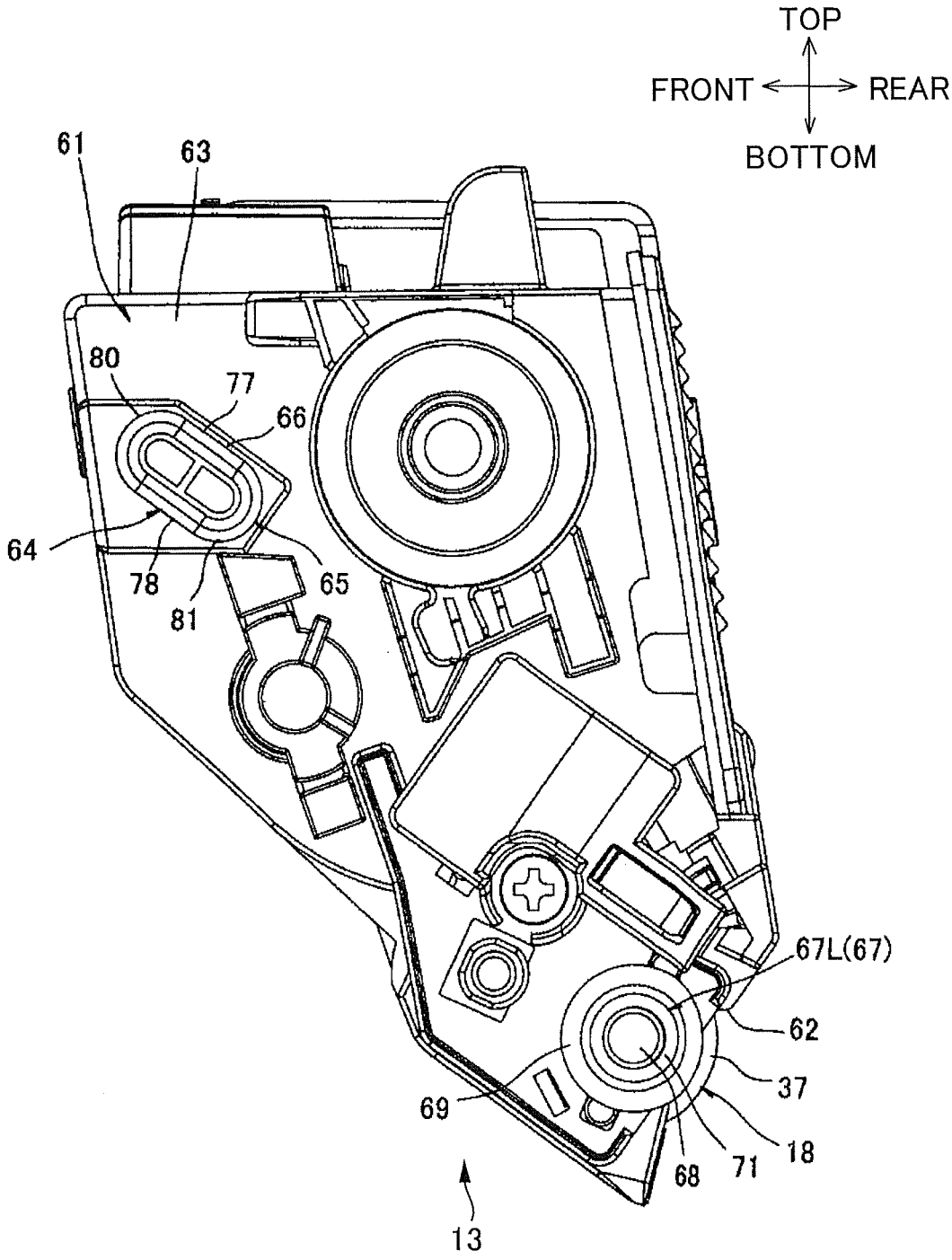
FIG. 4 is a left side view of the developing unit provided in the color laser printer shown in FIG. 1.
Figure 5:
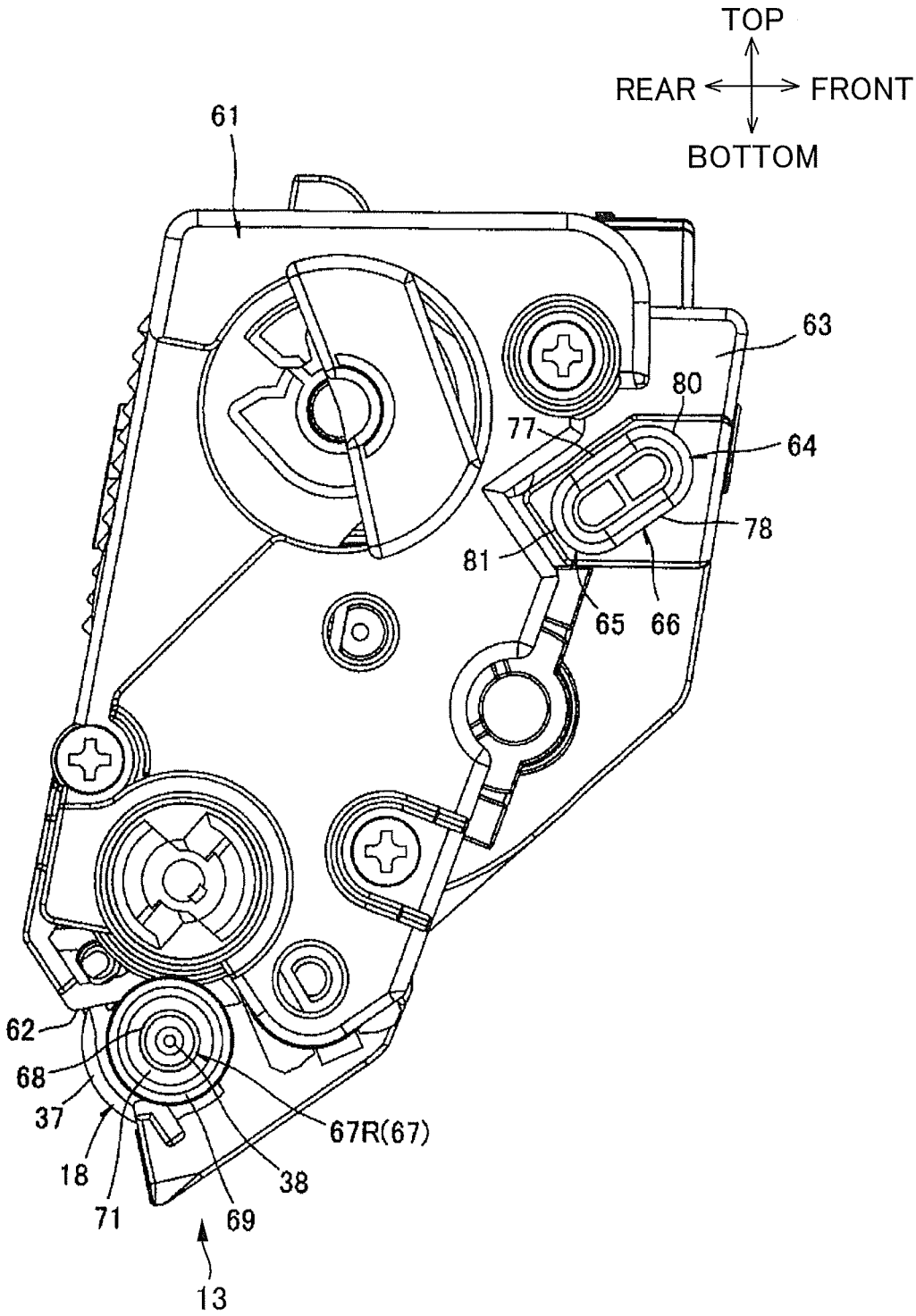
FIG. 5 is a right side view of the developing unit provided in the color laser printer shown in FIG. 1.

Further, as shown in FIGS. 4 and 5, the developing unit frame 61 is formed with an opening 62. The opening 62 is formed in a lower rear portion of the developing unit frame 61 across the entire length in the rightward/leftward direction.

Further, the developing unit frame 61 has right and left side walls 63 at right and left ends thereof.

Each side wall 63 has an upper front portion provided with a boss 64. The right boss 64 protrudes integrally from the right side wall 63 and the left boss 64 protrudes integrally from the left side wall 63. That is, each boss 64 is provided at the developing unit frame 61.

Each boss 64 has an elliptic cylindrical configuration protruding outward in the rightward/leftward direction from the side wall 63 (FIG. 3). In other words, the boss 64 is formed in a cylindrical shape having an elliptical cross-section. The boss 64 is provided with a pair of planar surfaces 66 and a pair of semi-circular surfaces 65. The planar surfaces 66 and the semi-circular surfaces 65 are integral with the boss 64 and constitute an outer peripheral surface of the elliptic cylindrical configuration. The pair of planar surfaces 66 includes an upper planar surface 77 and a lower planar surface 78. The pair of semi-circular surfaces 65 includes an upper semi-circular surface 80 and a lower semi-circular surface 81. The upper and lower planar surfaces 77, 78 are arranged parallel to and in confrontation with each other in a side view. The upper semi-circular surface 80 is connected to upper ends of the upper and lower planar surfaces 77, 78. The lower semi-circular surface 81 is connected to lower ends of the upper and lower planar surfaces 77, 78.

The upper and lower planar surfaces 77, 78 are inclined so as to extend diagonally upward toward the front.

More specifically, the upper and lower planar surfaces 77, 78 are arranged so as to extend in a moving direction that the developing roller 18 moves to a contact position from a separation position described later (i.e. in the second direction Y). Each of the upper and lower planar surfaces 77, 78 has a longitudinal length greater than a distance that a developing roller shaft 38 of the developing roller 18 moves when the developing roller 18 moves to the contact position from the separating position.

Further, the upper and lower planar surfaces 77, 78 define a distance therebetween in a confronting direction that the upper and lower planar surfaces 77, 78 confront each other, the distance being substantially one-half of a longitudinal length of the boss 64.

Further, the lower planar portion 78 is arranged so as to be in abutment with the roller 50 when the developing unit 13 is in a pressed position described later (FIG. 6).

The upper semi-circular surface 80 is connected to the upper ends of the upper and lower planar surfaces 77, 78 and arranged so as to be in pressure contact with the pressure cam 44 when the developing unit 13 is in the pressed position described later (FIG. 6).

Further, the lower semi-circular surface 81 is connected to lower ends of the upper and lower planar surfaces 77, 78 and arranged so as to be in contact with the separating portion 54 of the separation cam 45 when the developing unit 13 is in a pressure release position described later (FIG. 6).

The lower planar portion 78 and the upper semi-circular portion 80 constitutes a directing portion for directing the developing unit frame 61 (the developing unit 13) to a predetermined orientation and for fixing a position of the developing unit frame 61 (the developing unit 13).

As shown in FIGS. 4 and 5, the developing roller 18 is provided with the developing roller shaft 38 formed in metal and an electrically-conductive rubber roller 37 covering the developing roller shaft 38.

Further, the developing roller 18 is provided in the lower rear portion of the developing unit frame 61 so that a lower rear surface of the rubber roller 37 is exposed through the opening 62 of the developing unit frame 61.

The developing roller shaft 38 of the developing roller 18 extends in the rightward/leftward direction and is rotatably supported to the side walls 63 of the developing unit frame 61. With this configuration, the developing roller 18 is rotatable relative to the side walls 63 of the developing unit frame 61.

The developing roller shaft 38 has right and left ends (axial ends) extending outward in the rightward/leftward direction through the side walls 63 (FIG. 3). Portions of the right end left ends of the developing roller shaft 38 protruding outward from the side walls 63 are fitted with the collar members 67, respectively.

Each collar member 67 is integrally provided with the cylindrical portion 68 and a flange portion 69, as shown in FIG. 3.

The cylindrical portion 68 has an inner diameter substantially the same as an outer diameter of the developing roller shaft 38. The cylindrical portion 68 has an outer diameter substantially the same as the distance between the bottom portion of the rear guide rib 40B and the bottom portion of the front guide rib 40F.

The flange portion 69 is formed in a generally annular shape so as to extend radially outward from a peripheral edge of the cylindrical portion 68. Further, the flange portion 69 has a surface connecting to the cylindrical portion 68 serving as the positioning surface 71. Further, the positioning surface 71 has a chamfered peripheral edge.

Further, each collar member 67 is fitted with each axial end of the developing roller shaft 38 so that the axial end of the developing roller shaft 38 is initially inserted into the flange portion 69 of the collar member 67. That is, each collar member 67 is fitted with each axial end of the developing roller shaft 38 so that the positioning surface 71 of the flange portion 69 is oriented outward in the rightward/leftward direction.

More specifically, the collar member 67 fitted with the right end of the developing roller shaft 38 (hereinafter referred to as the right collar member 67R) has the cylindrical portion 68 having one end connected to the flange portion 69 and another end formed with an opening. Through the opening, the right end of the developing roller shaft 38 protrudes outward in the rightward/leftward direction (i.e. rightward).

The collar member 67 fitted with the left end of the developing roller shaft 38 (hereinafter referred to as the left collar member 67L) has the cylindrical portion 68 having one end connected to the flange portion 69 and another end that is closed.

A plane F including the positioning surface 71 and orthogonal to an axial direction of the developing roller 18 intersects the boss 64 extending in the rightward/leftward direction.

Specifically, a part of the upper semi-circular surface 80 and a part of the lower planar surface 78 of the boss 64, and the positioning surface 71 are located on the plane F orthogonal to the axial direction of the developing roller 18.

3. Mounting and Removal of Developing Unit relative to Process Frame

To mount the developing unit 13 in the process frame 15, a user initially holds the handle 72 of the developing unit 13, and, in a state that the process frame 15 has been pulled outward of the main casing 2, places the developing unit 13 above the process frame 15 at a position above the corresponding photosensitive drum 14 in the frontward/rearward direction.

At this time, the user inserts his fingers into the notch 73 of the developing unit 13 from its front side, and grabs the handle 72.

Then, the user moves the developing unit 13 downward to insert the developing unit 13 in the process frame 15 from the bottom of the developing unit 13.

At this time, when the developing unit 13 is inserted into the process frame 15, each collar member 67 of the developing roller shaft 38 is fitted in the first guide groove 39A of the corresponding guide groove 39 formed in the side plate 35 of the process frame 15 from above. That is, the left collar member 67L of the developing roller shaft 38 is fitted in the first guide groove 39A of the left side plate 35 from above and the right collar member 67R of the developing roller shaft 38 is fitted in the first guide groove 39A of the right side plate 35.

As a result, as shown in FIG. 6, the right and left collar members 67R, 67L of the developing roller shaft 38 is guided by the first guide grooves 39A of the corresponding guide grooves 39, so that the developing unit 13 is inserted into the process frame 15 in the first direction X such that the developing unit 13 is moved slightly rearward toward the bottom. That is, the first direction X is oriented in a mounting direction of the developing unit 13 relative to the process frame 15.

Subsequently, after the right and left collar member 67R, 67L of the developing roller shaft 38 reach bottom portions of the first guide grooves 39A of the guide grooves 39, the user continues to insert the developing unit 13 into the process frame 15.

Then, the cylindrical portions 68 of the right and left collar members 67R, 67L are guided by the second guide grooves 39B of the corresponding guide grooves 39, so that the developing unit 13 is moved in the second direction Y. Hence, the right and left collar members 67R, 67L reach bottommost portions of the second guide grooves 39B of the guide grooves 39.

At this time, the positioning surfaces 71 of the flange portions 69 of the right and left collar members 67R, 67L are respectively brought into abutment on the restricting surfaces 75 of the right and left side plates 35, thereby positioning the developing unit frame 61 relative to the process frame 15 in the rightward/leftward direction (the axial direction of the developing roller shaft 38).

As a result, the developing unit 13 is brought into the pressure release position.

At this time, the developing roller 18 contacts the corresponding photosensitive drum 14 in the second direction Y, that is, in the radial direction of the photosensitive drum 14 from diagonally above and front (FIG. 1).

Further, the pressure cams 44 and the separation cams 45 of the right and left side plates 35 are respectively in the standby position. The connected portion 47' of each pressure cam 44 confronts the front surface of the separating portion 54 of the corresponding separation cam 45 at a distance smaller than the longitudinal length of the boss 64 (indicated by a broken line in FIG. 6) of the developing unit 13. Here, the longitudinal length of the boss 64 implies a total of the longitudinal length of the planar surface 66 and the diameter of the respective semi-circular surface 65.

Each boss 64 of the developing unit 13 confronts, from upper rear, a space defined between the corresponding pressure cam 44 and the separating portion 54 of the corresponding separation cam 45. More specifically, the upper semi-circular surface 80 contacts the arcuate surface 47 of the pressure cam 44 from above and the lower semi-circular surface 81 contacts the separating portion 54 of the separation cam 45 from above.

In other words, when the developing unit 13 is in the pressure release position, each boss 64 of the developing unit 13 is located at a position to which a pressure force from the corresponding pressure cam 44 is not applied. Hence, the upper semi-circular surface 80 of the boss 64 is released from the pressure force from the pressure cam 44.

Accordingly, when being in the pressure release position, the developing unit 13 is removable from the process frame 15.

Next, the user holds the handle 72 to pivotally move the developing unit 13 frontward while the developing unit 13 is in the pressure release position.

At this time, the user pulls the handle 72 frontward while holding the handle 72 from the rear by inserting his fingers into a rear portion of the notch 73 of the developing unit 13 from above.

The developing unit 13 is thus pivotally moved frontward about the developing roller shaft 38. In association with pivotal movement of the developing unit 13, the right and left bosses 64 are also pivotally moved about the developing roller shaft 38. That is, each boss 64 is moved diagonally below and frontward toward a position between the corresponding pressure cam 44 and the corresponding separation cam 45 (the separating portion 54), both being in the standby position.

At this time, each boss 64 presses, diagonally upward and forward, a lower portion of the arcuate surface 47 of the corresponding pressure cam 44 that is in the standby position so as to expand the space defined between the pressure cam 44 and the separating portion 54 of the separation cam 45.

More specifically, the upper semi-circular surface 80 presses the lower portion of the arcuate surface 47 diagonally upward and forward by bringing the upper semi-circular surface 80 into contact with the arcuate surface 47 of the pressure cam 44 as well as by bringing the lower semi-circular surface 81 into contact with the front surface of the separating portion 54 of the separation cam 45.

As a result, the pressure cam 44 is pivotally moved about the rotation shaft 48 diagonally upward and forward. Accordingly, the developing unit 13 is moved to the pressed position.

When the pressure cam 44 is pivotally moved diagonally upward and forward, the pressure cam 44 is separated farther from the separating portion 54 of the separation cam 45. Since the distance between the arcuate surface 47 of the pressure cam 44 and the front surface of the separating portion 54 of the separation cam 45 becomes greater, the boss 64 (indicated by a solid line in FIG. 6) can move into a position between the pressure cam 44 and the separating portion 54 of the separation cam 45.

A contact position where the boss 64 contacts the arcuate surface 47 of the corresponding pressure cam 44 is set such that, when the developing unit 13 is moved to the pressed position from the pressure release position, the rotation shaft 48 of the pressure cam 44 is not positioned in a direction that the boss 64 presses the pressure cam 44. Thus, the boss 64 presses the corresponding pressure cam 44 to smoothly pivotally move the pressure cam 44 in a direction diagonally upward and forward.

Further, when the developing unit 13 is pivotally moved to the pressed position from the pressure release position, the pressure cam 44 is initially in contact with the upper semi-circular surface 80 of the boss 64 from the front, and then, moves around the upper semi-circular surface 80 while maintaining a state that the pressure cam 44 is in contact with the upper semi-circular surface 80, and contacts the upper semi-circular portion 80 from the upper front. Hence, while the developing unit 13 is being pivotally moved, the pressure cam 44 does not press the upper semi-circular surface 80 of the corresponding boss 64 at least upward. Hence, the developing unit 13 can be prevented from being unintentionally moved upward.

When each boss 64 is moved into the space defined between the pressure cam 44 and the separating portion 54 of the separation cam 45, the upper semi-circular surface 80 of the boss 64 is brought into contact with the lower surface 46B of the pressure cam 44.

Further, the lower planar surface 78 of the boss 64 is brought into abutment with the roller 50 provided at the depressed portion 43. As a result, pivotal movement of the developing unit 13 is stopped. At this time, the lower planar portion 78 extends in the second direction Y.

That is, when the developing unit 13 is in the pressed position, each upper semi-circular surface 80 is pressed by the corresponding pressure cam 44. More specifically, the pressure cam 44 presses the upper semi-circular surface 80 of the boss 64 diagonally downward and rearward by the urging force of the urging member (not shown) provided in the pressure cam 44.

At this time, the lower planar surface 78 is positioned downstream of the upper semi-circular surface 80 in a pressing direction of the pressure cam 44 that the pressure cam 44 presses the boss 64.

Figure 7:
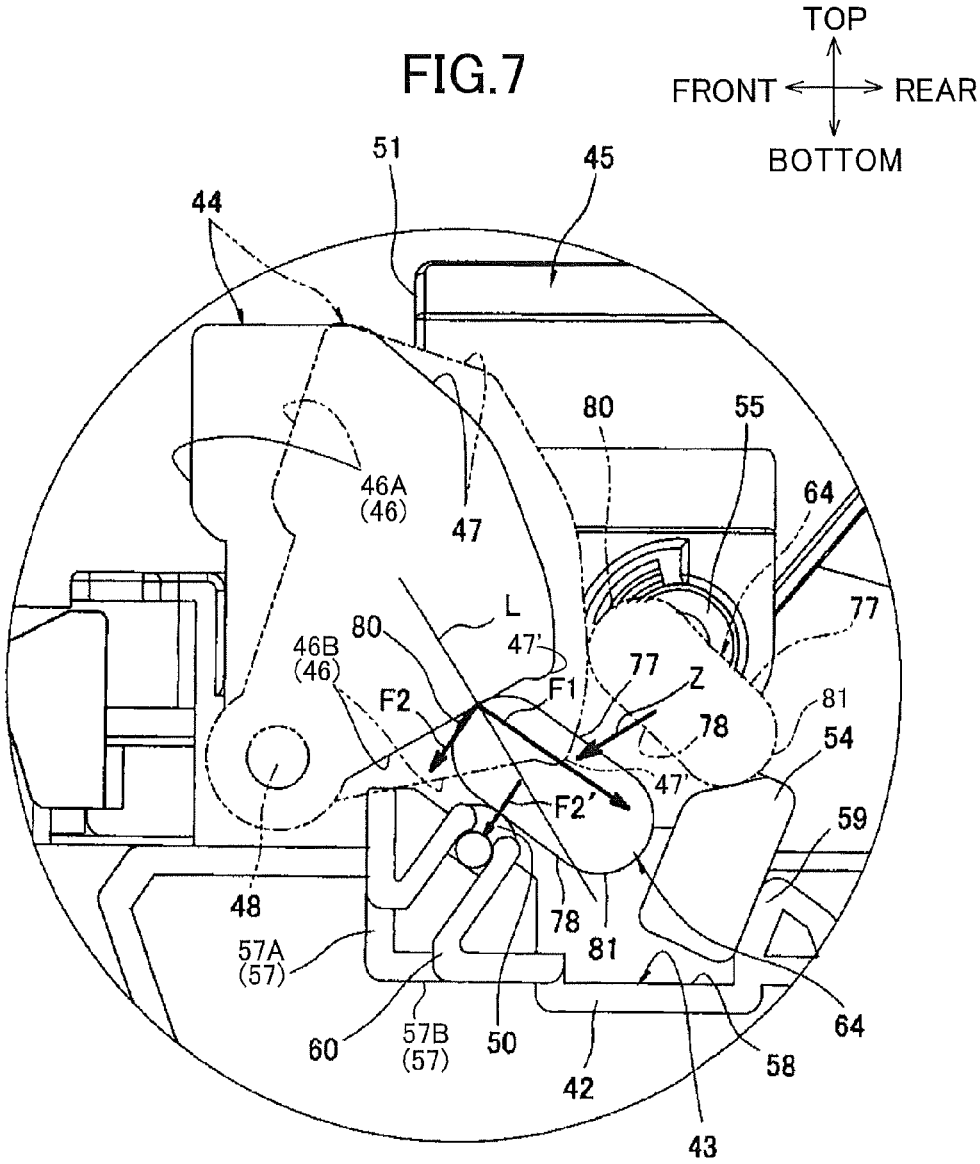
FIG. 7 is an enlarged view of a pressure cam and a boss shown in FIG. 6.
Figure 8:
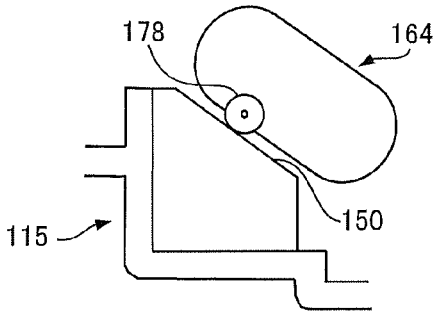
FIG. 8 is a schematic view of a roller provided at a boss and a planar surface provided at a process frame according to one modification of the present invention.

More specifically, as shown in FIG. 7, the lower planar surface 78 is positioned downstream of a normal line L to the upper semi-circular portion 80 at a contact point where the upper semi-circular surface 80 and the lower surface 46B contact each other in a moving direction Z of the developing unit 13 that the developing unit 13 is moved to the pressed position from the pressure release position.

The pressure force from the pressure cam 44 is resolved into a pressure force component F1 and a positioning force component F2. The pressure force component F1 serves as a pressure force to press the developing roller 18 toward the photosensitive drum 14. The positioning force component F2 serves as a pressure force to press the lower planar surface 78 toward the roller 50.

More specifically, the pressure force component F1 is applied to the developing roller 18 in a direction parallel to the second direction Y, because the cylindrical portion 68 of each collar member 67 is guided by the second guide groove 39B of the side plate 35.

The positioning force component F2 is applied to the lower planar surface 78 in a direction along a normal line to the roller 50 at a contact point where the lower planar surface 78 and the roller 50 contact each other.

In other words, when each boss 64 of the developing unit 13 is pressed by the corresponding pressure cam 44 diagonally downward and rearward, the developing roller 18 of the developing unit 13 is brought into pressure contact with the photosensitive drum 14 from the upper front by the pressure force component F1 directed parallel to the second direction Y.

Further, the lower planar surface 78 of the boss 64 is brought into pressure contact with the roller 50 from the above by the positioning force component F2 (a positioning force component F2' shown in FIG. 7).

As a result, the developing unit 13 is subjected to positioning in the frontward/rearward direction and in the upward/downward direction relative to the process unit 9. Accordingly, rattling of the developing unit 13 relative to the process unit 9 can be prevented.

As described above, the developing unit 13 is moved to the pressed position from the pressure release position to be pressed by each pressure cam 44, thereby being completely mounted in the process frame 15.

At this time, as shown in FIG. 3, the upper semi-circular surface 80, the pressure cam 44, the lower planar surface 78, and the positioning surface 71 are located on the plane F that is orthogonal to the axial direction of the developing roller 18.

More specifically, the contact point where the upper semi-circular surface 80 and the pressure cam 44 contact each other, the contact point where the lower planar surface 78 and the roller 50 contact each other, and the positioning surface 71 are located on the plane F that is orthogonal to the axial direction of the developing roller 18.

To remove the developing unit 13 from the process frame 15, the user performs in reverse order the above-described operation for mounting the developing unit 13 in the process frame 15.

More specifically, the user holds the handle 72 to pivotally move the developing unit 13 to the pressure release position from the pressed position.

In other words, the developing unit 13 (the developing unit frame 61) is pivotally movable between the pressed position and the pressure release position.

Next, when the developing unit 13 is in the pressure release position, the user holds the handle 72 to pull the developing unit 13 upward, thereby removing the developing unit 13 from the process frame 15.

5. Separation and Contact of Developing Unit relative to Photosensitive Drum

Hereinafter separation and contact movements of the developing unit 13 relative to the photosensitive drum 14 will be described while referring to FIGS. 6 and 7.

In the color laser printer 1, either a color mode for forming a color image or a monochromatic mode for forming a black image can be selected.

When the color laser printer 1 is in the color mode, as described above, the developing rollers 18 of all the developing units 13 are in contact with their respective photosensitive drums 14.

When the color laser printer 1 is in the monochromatic mode, although not shown, the black developing unit 13K is in contact with the black photosensitive drum 14K while the non-black developing units 13 (i.e. the yellow developing unit 13Y, the magenta developing unit 13M, and the cyan developing unit 13C) are spaced apart from their respective photosensitive drums 14 (i.e. the yellow photosensitive drum 14Y, the magenta photosensitive drum 14M, and the cyan photosensitive drum 14C).

In order to separate the developing unit 13 from the corresponding photosensitive drum 14, the projecting portion 56 of each separation cam 45 corresponding to the developing unit 13 to be separated from the photosensitive drum 14 is pressed by a linearly movable cam mechanism (not shown) provided in the main casing 2.

Then, the separation cam 45 is pivotally moved about the rotation shaft 55 in the clockwise direction in FIG. 6 against the urging force of the urging member (not shown).

In association with pivotal movement of the separation cam 45, the separating portion 54 of the separation cam 45 is also pivotally moved about the rotation shaft 55 diagonally upward and frontward to press the lower semi-circular surface 81 of the boss 64 of the developing unit 13 diagonally upward and forward.

At this time, each boss 64 of the developing unit 13 is pressed by the separation cam 45 (the separating portion 54) diagonally upward and forward. At the same time, the upper semi-circular surface 80 of each boss 64 presses the pressure cam 44 upward from below.

Then, the developing unit 13 is moved diagonally upward and forward. Concurrently therewith, the cylindrical portion 68 of each collar member 67 is guided by the second guide groove 39B of the corresponding side plate 35 to be moved diagonally upward and forward in the second direction Y.

As a result, the developing roller 18 is brought into the separation position where the developing roller 18 is spaced apart from the corresponding photosensitive drum 14.

In order to bring the developing roller 18 spaced apart from the corresponding photosensitive drum 14 into contact with the photosensitive drum 14, a pressure force applied to the projecting portion 56 of each separation cam 45 is released.

When the pressure force applied to the projecting portion 56 is released, the upper semi-circular surface 80 of each boss 64 of the developing unit 13 is again pressed by the pressure cam 44, as described above.

The cylindrical portion 68 of each collar member 67 is guided by the second guide groove 39B of the corresponding side plate 35, so that the developing roller 18 of the developing unit 13 is brought into pressure contact with the corresponding photosensitive drum 14 in the second direction Y from the upper front.

As a result, the developing roller 18 is brought into the contact position where the developing roller 18 is in contact with the corresponding photosensitive drum 14.

That is, the developing roller 18 of the developing unit 13 is movable between the separation position and the contact position in the second direction Y when the developing unit 13 is in the pressed position.

6. Operations and Effects (1) The developing unit 13 includes the developing roller 18 and the developing unit frame 61.

The developing roller 18 is disposed at the lower rear portion of the developing unit frame 61 so that the lower rear surface of the rubber roller 37 is exposed through the opening 62 formed in the developing unit frame 61.

Further, the developing unit frame 61 is provided with the bosses 64 at the respective right and left side walls 63.

Each boss 64 is integrally provided with the upper semi-circular surface 80 and the lower planar surface 78.

Accordingly, when the upper semi-circular surface 80 is pressed by the corresponding pressure cam 44 provided in the process frame 15, the pressure force component F1 of the pressure force from the pressure cam 44 acts on the developing roller 18 and the positioning force component F2 of the pressure force from the pressure cam 44 (the positioning force component F2') directly acts on the lower planar surface 78.

As a result, a loss of the positioning force component F2 relative to the lower planar surface 78 can be reduced, thereby allowing the positioning force component F2 (i.e. the positioning force component F2') to efficiently act on the lower planar surface 78.

Further, because the loss of the component force of the pressure force can be reduced, the pressure force from the pressure cam 44, that is, the pressure force component F1 can be efficiently applied to the developing roller 18.

Accordingly, according to the developing unit 13, the process unit 9, and the color laser printer 1, rattling of the developing unit 13 relative to the drum unit 12 can be prevented. Hence, stable contact between the developing roller 18 and the photosensitive drum 14 can be enhanced. Therefore, occurrence of degradation in image formation can be restrained.

(2) Further, the lower planar surface 78 is positioned downstream of the upper semi-circular surface 80 in the pressing direction of the pressure cam 44.

Hence, the positioning force component F2 (the positioning force component F2') of the pressure force from the pressure cam 44 can be efficiently applied to the lower planar surface 78.

As a result, the lower planar surface 78 is brought into a pressure contact with the corresponding roller 50 of the process frame 15, thereby positioning the developing unit 13 relative to the drum unit 12 in the frontward/rearward direction and in the upward/downward direction.

Accordingly, according to the developing unit 13, the process unit 9, and the color laser printer 1, positioning accuracy of the developing unit 13 relative to the drum unit 12 can be improved. Further, occurrence of degradation in image formation can be restrained.

(3) Further, when the developing unit 13 is mounted in the drum unit 12, the developing unit 13 is movable between the pressed position and the pressure release position. When the developing unit 13 is in the pressed position, the developing unit 13 is subjected to positioning relative to the drum unit 12.

More specifically, when the developing unit 13 is in the pressed position, each upper semi-circular surface 80 is pressed by the corresponding pressure cam 44 and each lower planar surface 78 is brought into abutment with the corresponding roller 50.

Accordingly, according to the developing unit 13, the process unit 9, and the color laser printer 1, the developing roller 18 of the developing unit 13 can be reliably pressed toward the corresponding photosensitive drum 14, thereby positioning the developing unit 13 relative to the drum unit 12.

(4) Further, each lower planar surface 78 is positioned downstream of the normal line L to the upper semi-circular portion 80 at the contact point where the corresponding upper semi-circular surface 80 and the corresponding pressure cam 44 in the moving direction Z of the developing unit 13 that the developing unit 13 moves to the pressed position from the pressure release position.

Hence, the positioning force component F2 (the positioning force component F2') of the pressure force from the pressure cam 44 can be efficiently applied to the lower planar surface 78.

Accordingly, according to the developing unit 13, the process unit 9, and the color laser printer 1, positioning accuracy of the developing unit 13 relative to the drum unit 12 can be improved. Further, occurrence of degradation in image formation can be restrained.

(5) Further, the developing roller 18 includes the developing roller shaft 38. Each of the right and left ends of the developing roller shaft 38 is provided with the collar member 67.

The collar member 67 has the positioning surface 71.

When the developing unit 13 is mounted in the drum unit 12, the upper semi-circular surface 80, the pressure cam 44, the lower planar surface 78, and the positioning surface 71 are located on the plane F that is orthogonal to the axial direction of the developing roller 18, as shown in FIG. 3.

More specifically, the contact point where the upper semi-circular surface 80 and the pressure cam 44 contact each other, the contact point where the lower planar surface 78 and the roller 50 contact each other, and the positioning surface 71 are located on the plane F that is orthogonal to the axial direction of the developing roller 18.

Hence, the pressure force from the pressure cam 44 (the pressure force component F1 and the positioning force component F2 (F2')) efficiently acts on the corresponding upper semi-circular surface 80 and the corresponding lower planar surface 78. Further, the developing unit 13 is subjected to positioning in the axial direction of the developing roller 18 relative to the drum unit 12.

Accordingly, according to the developing unit 13, the process unit 9, and the color laser printer 1, positioning accuracy of the developing unit 13 relative to the drum unit 12 can be improved. Further, occurrence of degradation in image formation can be restrained.

(6) Further, in the process unit 9, each roller 50 serves as a positioning portion and each lower planar surface 78 serves as a positioned portion.

Hence, the lower planar surface 78 is brought into stable abutment with the corresponding roller 50.

Accordingly, according to the developing unit 13, the process unit 9, and the color laser printer 1, positioning accuracy of the developing unit 13 relative to the drum unit 12 can be improved. Further, occurrence of degradation in image formation can be restrained.

(7) Further, the developing roller 18 is movable between the contact position and the separation position when the developing unit 13 is in the pressed position.

Further, each lower planar surface 78 extends in the moving direction of the developing roller 18 that the developing roller 18 is moved to the contact position from the separation position, that is, in the second direction Y.

Hence, according to the developing unit 13, the process unit 9, and the color laser printer 1, the developing roller 18 can be appropriately and smoothly separated from and brought into contact with the corresponding photosensitive drum 14.

(8) Further, the process unit 9 includes the developing units 13 and the drum unit 12. The drum unit 12 includes the process frame 15. The process frame 15 includes the photosensitive drums 14, the pressure cams 44, and the rollers 50.

Hence, when each upper semi-circular surface 80 is pressed by the corresponding pressure cam 44, the pressure force component F1 of the pressure force from the pressure cam 44 acts on the developing roller 18 and the positioning force component F2 (the positioning force component F2') of the pressure force from the pressure cam 44 directly acts on the lower planar surface 78.

As a result, the lower planar surface 78 is brought into abutment with the corresponding roller 50, thereby positioning the developing unit 13 relative to the drum unit 12 in the frontward/rearward direction and in the upward/downward direction.

Accordingly, according to the process unit 9 and the color laser printer 1, rattling of the developing unit 13 relative to the drum unit 12 can be prevented. Further, stable contact between the developing roller 18 and the corresponding photosensitive drum 14 can be enhanced. Therefore, occurrence of degradation in image formation can be restrained.

7. Modifications

Various modifications are conceivable.

In the above-described color laser printer 1, the process frame 15 is provided with the rollers 50 and each boss 64 of the developing unit frame 61 is provided with the lower planar surface 78. Instead, a process frame 115 may have a planar surface 150 as the claimed positioning portion and each boss 164 of the developing unit frame 61 may have a roller 178 as the claimed positioned portion abuttable on the planar surface 150.

With this configuration, in the same manner as the above-described developing unit 13, the process unit 9, and the color laser printer 1, rattling of the developing unit 13 relative to the drum unit 12 can be prevented. Further, stable contact between the developing roller 18 and the photosensitive drum 14 can be enhanced.

Further, in the above-described embodiment, the four photosensitive drums 14 corresponding to each color are mounted in the process frame 15. However, the process frame 15 may support only a single photosensitive drum 14. That is, the above-described embodiment is applicable not only to the color laser printer 1 but also to a monochromatic printer.

While the present invention has been described in detail with reference to the present embodiments thereof, it would be apparent to those skilled in the art that various changes and modifications may be made therein without departing from the spirit of the present invention.

What is claimed is:

1. A developing unit detachably mountable in a photosensitive member unit including a photosensitive member on which an electrostatic latent image is formable, a pressing member, and a positioning portion, the developing unit comprising:

a developing unit frame;

a developing roller rotatably supported by the developing unit frame, and configured to supply developing agent to the electrostatic latent image formed on the photosensitive member; and a directing portion fixed to the developing unit frame configured to direct the developing unit frame to a predetermined orientation and to fix a position of the developer unit frame, the directing portion comprising:

a pressed portion configured to receive a pressure force from the pressing member for moving the developing roller toward the photosensitive member; and a positioned portion abuttable on the positioning portion for positioning the developing unit relative to the photosensitive member unit, wherein one of the positioning portion and the positioned portion includes a planar portion abuttable on the other of the positioning portion and the positioned portion, wherein the developing unit frame is movable between a pressed position where the pressed portion receives the pressure force from the pressing member and a pressure release position where the pressure force from the pressing member to the pressed portion is shut off, when the developing unit frame is mounted in the photosensitive member unit, wherein, when the developing unit frame is in the pressed position, the developing roller is movable between a separation position where the developing roller is spaced apart from the photosensitive member and a contact position where the developing roller is in contact with the photosensitive member, and wherein the planar portion extends in a moving direction of the developing roller from the separation position toward the contact position.

2. The developing unit as claimed in claim 1, wherein the pressed portion and the positioned portion are integral with the developing unit frame.

3. The developing unit as claimed in claim 1, wherein the positioned portion is positioned downstream of the pressed portion in a pressure direction in which the pressure force from the pressing member is directed.

4. The developing unit as claimed in claim 1, wherein the positioned portion is in abutment with the positioning portion, thereby positioning the developing unit frame relative to the photosensitive member unit when the developing unit frame is in the pressed position.

5. The developing unit as claimed in claim 4, wherein the pressed portion has a curved surface contactable with the pressing member and defines a normal line at a contact point between the curved surface and the pressing member, and wherein the positioned portion is positioned downstream of the normal line in a moving direction of the developing unit frame from the pressure release position toward the pressed position.

6. The developing unit as claimed in claim 1, wherein the photosensitive member unit has a guide portion having a restricting surface, wherein the developing roller extends in an axial direction and has axial end portions each provided with a collar member capable of fitting with the guide portion to guide removal of the developing unit frame from the photosensitive member unit and mounting of the developing unit frame in the photosensitive member unit, wherein the collar member has a positioning surface abuttable on the restricting surface for positioning the developing unit frame relative to the photosensitive member unit in the axial direction of the developing roller when the developing unit frame is mounted in the photosensitive member unit, and wherein, when the developing unit frame is mounted in the photosensitive member unit, the pressed portion, the pressing member, the positioned portion, and the positioning surface are located on a plane orthogonal to the axial direction of the developing roller.

7. The developing unit as claimed in claim 1, wherein the positioning portion includes a roller, and the positioned portion includes a planar portion abuttable on the roller.

8. The developing unit as claimed in claim 7, wherein the directing portion is a boss protruding integrally from the developing unit frame, the boss having an outer peripheral surface including the planar portion defining the positioned portion and a curved surface defining the pressed portion.

9. The developing unit as claimed in claim 1, wherein the positioning portion includes a planar portion and the positioned portion includes a roller abuttable on the planar portion.

10. A process unit comprising:

a developing unit; and a photosensitive member unit comprising a photosensitive member on which an electrostatic latent image is formable, a pressing member, and a positioning portion, the developing unit being detachably mountable in the photosensitive member unit, the developing unit comprising:

a developing unit frame;

a developing roller rotatably supported by the developing unit frame, and configured to supply developing agent to the electrostatic latent image formed on the photosensitive member; and a directing portion fixed to the developing unit frame configured to direct the developing unit frame to a predetermined orientation and to fix a position of the developer unit frame, the directing portion comprising:

a pressed portion configured to receive a pressure force from the pressing member for moving the developing roller toward the photosensitive member; and a positioned portion abuttable on the positioning portion for positioning the developing unit relative to the photosensitive member unit, wherein one of the positioning portion and the positioned portion includes a planar portion abuttable on the other of the positioning portion and the positioned portion, wherein the developing unit is movable between a pressed position where the pressed portion receives the pressure force from the pressing member and a pressure release position where the pressure force from the pressing member to the pressed portion is shut off, when the developing unit is mounted in the photosensitive member unit, wherein, when the developing unit is in the pressed position, the developing roller is movable between a separation position where the developing roller is spaced apart from the photosensitive member and a contact position where the developing roller is in contact with the photosensitive member, and wherein the planar portion extends in a moving direction of the developing roller from the separation position toward the contact position.

11. The process unit as claimed in claim 10, further comprising:

a guide portion configured to guide removal of the developing unit from the photosensitive member unit and mounting of the developing unit in the photosensitive member unit; and a photosensitive member unit frame for retaining the developing unit, wherein the positioning portion is fixed to the photosensitive member unit frame, the guide portion being integral with the photosensitive member unit frame.

12. The process unit as claimed in claim 11, wherein the guide portion has a restricting surface, wherein the developing roller extends in an axial direction and has axial end portions each provided with a collar member capable of fitting with the guide portion to guide removal of the developing unit from the photosensitive member unit and mounting of the developing unit in the photosensitive member unit, wherein the collar member has a positioning surface abuttable on the restricting surface for positioning the developing unit relative to the photosensitive member unit in the axial direction of the developing roller when the developing unit is mounted in the photosensitive member unit, and wherein, when the developing unit is mounted in the photosensitive member unit, the pressed portion, the pressing member, the positioned portion, and the positioning surface are located on a plane orthogonal to the axial direction of the developing roller.

13. The process unit as claimed in claim 10, wherein the pressed portion and the positioned portion are integral with the developing unit frame.

14. The process unit as claimed in claim 10, wherein the positioned portion is positioned downstream of the pressed portion in a pressure direction in which the pressure force from the pressing member is directed.

15. The process unit as claimed in claim 10, wherein the positioned portion is in abutment with the positioning portion, thereby positioning the developing unit relative to the photosensitive member unit when the developing unit is in the pressed position.

16. The process unit as claimed in claim 15, wherein the pressed portion has a curved surface contactable with the pressing member and defines a normal line at a contact point between the curved surface and the pressing member, and wherein the positioned portion is positioned downstream of the normal line in a moving direction of the developing unit from the pressure release position toward the pressed position.

17. The process unit as claimed in claim 10, wherein the positioning portion includes a roller, and the positioned portion includes a planar portion abuttable on the roller.

18. The process unit as claimed in claim 17, wherein the directing portion is a boss protruding integrally from the developing unit frame, the boss having an outer peripheral surface including the planar portion defining the positioned portion and a curved surface defining the pressed portion.

19. The process unit as claimed in claim 10, wherein the positioning portion includes a planar portion and the positioned portion includes a roller abuttable on the planar portion.

20. An image forming device comprising the process unit as claimed in claim 10.

* * * * *